United States Patent [19]

Arendt et al.

[11] 4,344,198

[45] Aug. 17, 1982

[54] PROCEDURE FOR WASHING CLOTHES

[75] Inventors: Hans F. Arendt, Sersheim; Ernst H. Hoffmann, Dortmund, both of Fed. Rep. of Germany

[73] Assignee: Hoesch Werke Aktiengesellschaft, Dortmund, Fed. Rep. of Germany

[21] Appl. No.: 149,116

[22] Filed: May 12, 19803441989310038159

[51] Int. Cl.[3] ..... D06F 23/02

[52] U.S. Cl. ..... 8/158; 8/159; 68/24; 68/58

[58] Field of Search ..... 8/158, 159, 137; 68/24, 68/58, 210

[56] References Cited

U.S. PATENT DOCUMENTS

| | | | |
|---|---|---|---|
| 2,556,490 | 6/1951 | Chamberlin | 8/159 |
| 2,615,320 | 10/1952 | Belaieff | 68/24 |
| 3,387,310 | 6/1968 | Marshall | 8/158 |

FOREIGN PATENT DOCUMENTS

| | | |
|---|---|---|
| 867235 | 2/1953 | Fed. Rep. of Germany . |
| 1681121 | 8/1954 | Fed. Rep. of Germany . |
| 1205936 | 6/1966 | Fed. Rep. of Germany . |
| 1953201 | 4/1970 | Fed. Rep. of Germany . |
| 1408823 | 7/1965 | France . |

OTHER PUBLICATIONS

Book entitled "Die Wascherei", by Dr. W. Kind and Dr. H. A. Kind published by Konradin Verlag, Stuttgart, 2nd Ed., 1956, pp. 218–219.

*Primary Examiner*—Philip R. Coe

*Attorney, Agent, or Firm*—Burton, Parker & Schramm

[57] ABSTRACT

The specification describes a procedure for the washing of clothes in a washing machine with a horizontal, perforated, driven tub arranged inside a housing, in which during the washing and rinsing cycles the clothes are repeatedly lifted up, and then fall in a trajectory onto the lower portion of the tub, and are then distributed and pressed against the tub wall, largely without unbalance, as the tub velocity is gradually increased, and are then centrifuged as the velocity is increased further.

19 Claims, 3 Drawing Figures

PROCEDURE FOR WASHING CLOTHES

The invention concerns a procedure for the washing of clothes in a washing machine with a horizontal, perforated, driven tub arranged inside a housing, in which during the washing and rinsing cycles the clothes are repeatedly lifted up, and then fall in a trajectory onto the lower portion of the tub, and are then distributed and pressed against the tub wall, largely without unbalance, as the tub velocity is gradually increased, and are then centrifuged as the velocity is increased further.

In conventional modern washing procedures the washing effect is achieved through relatively large water/clothes ratios of the wash and rinse media, in which one of the biggest problems is the achievement of a sufficient exchange between the "free" and the "engaged" media. Primarily the medium contained in the wrinkles of the clothes and between the threads of the textile material flows out, while an exchange of the liquid adhering to the surface of individual textile fibres and filling the spaces between the fibres takes place slowly and in most cases insufficiently. The large medium/clothes ratios result in high water consumption, and the heating of this water results in high energy consumption (see, for example, German Pat. No. 867,235).

With problem clothes, such as geriatric or miner's work clothes, which often contain soil particles weighing 50% or more of their own weight, several wash and rinse operations are necessary.

It is the object of the invention to show a procedure which requires only one wash operation, even for problem clothes, and in which the water and energy requirements are reduced.

Surprisingly, this is achieved by wetting the clothes with an amount of suds that gives a "doughy" consistency to the clothes and fills the housing with suds until the head of suds does not significantly rise beyond the tangential area of the tub; the dry clothes are loaded individually into the tub which rotates at a speed at which the centrifugal velocity at the tub case is about 0.3–0.8 g, then the tub velocity is increased to almost 1 g, then the speed is gradually changed to spin speed, and after spinning, the speed is reduced again to a velocity in keeping with the loading speed, and at least one rinse cycle follows which is similar to the wash cycle.

Preferably, the clothes are wetted with an amount of suds that equals approximately 30–70% of the clothes' absorption capacity.

It is practicable to fill "free" medium into the housing and to maintain the medium level in the tub until the predetermined degree of wetting is reached.

This is best achieved by maintaining in the tub a medium level of less than about 5% of the tub diameter.

If necessary, the medium level can be increased to about 10% of the tub diameter to achieve even wetting of the clothes, particularly by filling up with water.

According to another feature of the procedure, concentrated suds are used.

The suds can be saturated, and sediment can be present.

According to a preferred embodiment of the procedure, a tub without carrying-vanes is used.

The next step in the procedure consists in washing the clothes at a tub speed at which an acceleration of about 0.8 to 0.95 g is produced at the tub case.

When spin speed is reached, it is practicable to increase the tub velocity in the range between the washing speed and about 2 g, depending on the unbalance.

In this, when an unbalance occurs, the tub velocity is reduced to below 1 g before it is accelerated again.

According to another essential characteristic of the procedure, the tub velocity of spinning is between 3–350 g.

At the end of spinning, the water can be filled into the housing, in which it is practicable to fill the water between housing and tub, in a quantity that ensures a considerably high dynamic pressure.

In accordance with the invention, the washing process consists of one wash cycle and 1–3 rinse cycles, regardless of how soiled the clothes are.

For all rinse cycles, water is used with a temperature that does not exceed the temperature of the suds and that is very similar to the latter.

Preferably, suds are used which contain detergents, and/or detergents are added to the rinse water.

Another suggestion according to the invention is to use a tub with a diameter between about 800 and 2000 mm.

The mechanism for this procedure consists of a washing machine with a horizontal, perforated, driven tub arranged inside a housing, a water level control unit, if necessary a tilt mechanism, and a program control unit with a device for changing the tub velocity, according to the invention including an oscillation control unit connected to the program control unit and to the motor via a comparator circuit to which a speed indicator is also connected.

According to the preferred embodiment of the mechanism, the housing and the tub each have in front, concentric to the tub axis, a loading port and—on the opposite side—an unloading port, whose diameters are greater than 120 mm.

In this, preferably the loading port is designed as a hollow shaft which widens conically toward the tub, and the tub can be mounted on the hollow shaft in a mounting that is preferably a hydrostatic mounting.

According to another suggestion, the washing machine is connected on the loading side to a chute that can be rolled away or that can swing on hinges.

In a further embodiment of the invention it is suggested that the space between tub and housing tapers in the direction of the rotation in at least one place.

Preferably the taper points sideways and upward; it is practicable to form the taper by arranging the tub excentrically inside the housing.

Contrary to the prevailing technical theory, according to which "free" medium must be present in a washing tub in excess of the absorption capacity of the clothes, and according to which a medium level of at least 20% of the tub diameter is regarded as practicable, it was found surprisingly that such a high proportion of "engaged" and "free" medium is unnecessary in the drum, that on the contrary it is an advantage to lower the proportion of "engaged" medium considerably. But this is possible only when the clothes are filled into the washing machine in dry state and are evenly wetted with ready-made suds. This means that when the washer is loaded, the suds must already be in the washer in the appropriate concentration, or the suds must be let in together with the clothes. It is important that the clothes are wetted moderately but as evenly as possible. For example, less than 6 kg (concentrated) suds can be added to 10 kg dry clothes, i.e. the clothes can have a degree of moisture only slightly above that which the clothes usually have after one spinning.

In many cases, however, a higher degree of moisture may be preferred which can vary according to the type of textile and the type of weave and which may reach 2 liters of suds per kg dry clothes. The correct degree of moisture of the clothes can be recognized by its "doughy" consistency. This means that a load of clothes thus moistened must have a certain elasticity, that it releases moisture at its base only in the form of a thin, liquid film, but that no water drips or flows out of it, even when kept for quite a long time.

The applicant does not wish to embrace a certain theory, but it is assumed that there must be enough suds to fill the spaces between the fibres of textile threads of the fabric, and that the surfaces of these fibres must be wetted as completely as possible. Since soil particles can occur in all these places, they must be wetted with suds as well. This is necessary as well as adequate to achieve a washing effect. According to the invention this is achieved by the fact that the clothes are individually loaded during wetting and that only a low medium level is retained in the tub, while the tub at that time rotates at a speed which prevents twisting of the clothes, and while the clothes are always about evenly distributed throughout the tub. This speed also depends on the material of the clothes and is approximately in the range at which the centrifugal acceleration produced at the tub wall is between 0.3 and 0.8 g.

The theoretically required amount of suds is thus very small. In practice, a certain surplus is used, since the water contained in the suds also serves as a means of moving the dissolved soil particles.

Since the tub is already rotated during the wetting process, the individual pieces of clothes are lifted up to a certain height and then dropped onto the lower portion of the tub in a parabolic fall line. The above speeds do not result in the maximum possible parabolic fall lines, which means that the clothes release a relatively small amount of liquid when they hit the tub wall but are able to absorb additional suds from the "free" medium. On the other hand, the speed is high enough for the head of suds in the tub to be slanted, so that with the already small ratio of media in the tub, no "free" medium is present where the clothes hit the tub wall, that therefore the suds can release liquid and back up into the tub area that lies behind at about the same level, can flow into the tub and be absorbed by the clothes.

Since the clothes are loaded in a dry state, they can be wetted quickly and evenly. If the spaces between the fibres (which are important for the wash cycle according to the invention) were already occupied by water, as for example by pre-soaking or by filling water into the tub for the subsequent production of suds, homogenous wetting could not take place, since it is extremely difficult to achieve an equilibrium of the suds concentration in this area in a short time. But if suds are introduced from the start, all that is required is mechanical action to wet all spaces carefully.

Even at this stage of the process, some of the soil particles are released to the "free" medium, i.e. the wash cycle has already begun. During the subsequent speed increase to a speed of between 0.8 to 0.95 g at the tub periphery, the mechanical action continues while the parabolic fall lines become higher. The exchange between "free" and "engaged" medium is intensified by this. Before or during this stage of the process, the suds level in the tub can be raised to about double of the previous level until it reaches about 10% of the tub diameter. Since the higher speed increases the above described tilting of the head of suds and increases the exchange between "free" and "engaged" media, the processes in the tub do not undergo any basic changes but only become intensified. But the addition of "free" medium causes an increase in the total amount of medium and its absorption capacity for the dissolved soil particles. Such an addition of "free" medium can thus be practical in the case of heavily soiled clothes. However, there should not be so much "free" medium in the tub that the clothes fall into the suds instead of onto the tub wall.

Since it is hoped to wash even problem clothes, i.e. geriatric clothes, industrial clothes, etc., in a single wash cycle, suds must be produced to which the entire amount of detergent is added. In the case of heavily soiled clothes, this could be concentrated suds, or even saturated suds with sediment.

With the above mentioned "doughy" consistency of the clothes, no carrying-vanes are necessary in the tub. Since considerably higher spin speeds are practical for the procedure, a tub without carrying-vanes is an advantage, because it prevents unbalance.

The spin cycle is started by discharging the soiled "free" medium. Then the tub speed is gradually increased, so that it is distributed in the tub without unbalance.

The tub velocity is preferably increased, depending on the unbalance, in such a way that the rotational speed is increased proportionally as the unbalance decreases. Thus it is possible to go through the critical range directly below 1 g, in which the clothes are pressed against the tub walls in such a way that high-speed operation is achieved without unbalance because the clothes are distributed in a completely even manner.

It is more difficult to remove the suds from the spaces between the fibres than to remove the suds between the individual textile fibres and in the wrinkles of the clothes. As a rule, higher speeds are necessary for this, but these depend on the material.

Spin speed can be reduced by treating the clothes with hot suds or hot rinse water. Warm rinse water not only dissolves the remaining suds from pores and capillaries better and faster, but it is also easier to be spun out of the clothes, because warm water has a lower viscosity than cold water and thus does not adhere as much in the capillaries and pores of the clothes. This effect is greatly multiplied by the fact that the clothes are treated with hot rinse water containing some detergent. A sufficient amount of detergent is always present in the rinse water, because during the washing process detergents are added which are carried over in sufficient amounts to the last rinse cycle. Thus the warm rinse water containing detergents has the advantage that low spin speeds are enough to remove the "engaged" medium.

Of course, the procedure according to the invention can also be used for heat-sensitive clothes, with relatively cold water. In this case, higher spin speeds must be used.

As mentioned, the spin speeds necessary depend on the material. Thus, with various polyester garments, the customary spinning speed of about 3 g can already lead to satisfactory results. For heavy cotton goods, on the other hand, spin speeds of 250–350 g are required.

At such high spin speeds, special attention must be paid that the clothes are distributed without unbalance.

If an unbalance occurs, a correction is possible only by reducing the speed to below 1 g and gradually increasing the speed again. At a speed of 2 g the distribution of the clothes is completed, and spinning can continue at higher speeds.

At the end of spinning, the tub must be slowed down. As suggested according to the invention, this is done by filling water into the housing, choosing the amount of water in such a way that it contacts the tub and carries it along, causing a considerable dynamic pressure in the space between housing and tub. This causes great turbulence of the water which can be utilized for rinsing the soil particles that have settled in the housing and on the outside of the tub. Another effect of the braking-water is that the clothes that are pressed hard against the tub wall by the considerable centrifugal acceleration and which are difficult to detach from the tub wall, are pushed away from the tub wall by the dynamic pressure of the water.

The wash cycle is followed by a rinse cycle which is analogous to the wash cycle. This means: the clothes are first distributed in the tub at 0.3–0.8 g, then the speed is accelerated to 0.95 g, and spinning begins after the rinse water is at least partly let out. Three rinse cycles are adequate even for problem clothes. Since the problem of exchanging remnants of suds in the capillary area is the same, the rinse medium ratio does not as a rule have to be greater than the wash medium ratio. Wetting the clothes more than necessary only leads to a waste of water whose effectiveness is out of proportion in terms of the energy required to move it. The exchange between "engaged" and "free" medium is achieved not so much by leaching but by the mechanical action of the tub. It has been shown that the tub has to be of a certain size to ensure that the clothes can fall with adequate force. The minimum diameter is thus 800 mm. Below this, the effectiveness drops very rapidly. A maximum size of 2000 mm is also indicated. Larger tubs can rotate at a slower angularly velocity, but the number of times each piece of clothing falls per second decreases. Even if the height of fall is increased, the number of falls for each piece of clothing must not be below a certain minimum.

The intermediate spin following the wash cycle and between rinse cycles does not require maximum speeds; for example, a speed of 80 g instead of 250 g could be used. This would enable some of the wash suds and the detergents they contain to be carried over to the next rinse cycle in a predetermined fashion. The degree of drainage also depends on the spin period.

It is recommended to use a somewhat greater medium ratio for the final spin. It should be noted that the desirable medium ratio for the wash cycle is at least 1:2, for the intermediate rinse 1:3.5, and for the final rinse 1:4. This is achieved by giving the portion of the housing below the tub, i.e. the suds or rinse water pan, appropriate dimensions. Thus, water is saved for the most part not by using smaller ratios of total media, but by reducing the number of wash and rinse cycles.

Energy is also saved through short operating periods. These have the advantage also that not much moisture can enter the textile fibres themselves and make them swell. Excessive swelling narrows the spaces between fibres and prevents suds from entering, which considerably reduces the effectiveness of the washing process. For this reason, too, prior wetting or soaking of the clothes is a disadvantage. Another significant advantage of this procedure is that it protects the clothes considerably more.

EXAMPLE 10 kg detergent were dissolved in 280 liters of water at 95° C. and filled into a washing machine with a tub volume of 2000 liters, until the medium level in the tub reached 6 cm. Now 170 kg industrial clothes, consisting of overalls and underwear from a mining operation (average soiling rate was 15–20% of the weight of the clothes) were individually loaded into the tub, maintaining the medium level until all suds were added. In this, the tub was moved at a speed of 28 rpm, and this speed was maintained after all the clothes were loaded. The entire wetting process took 5 minutes. Then another 315 liters of water at 95° C. were added, and the tub speed was increased to 31 rpm. At a tub radius of 80 cm, this equals a speed at which the centrifugal acceleration at the tub periphery is 0.8 g. The washing period was 6 minutes.

Then the used wash medium was drained, the tub speed was slowly increased to 3.3 g (62 rpm), and then further increased to 250 rpm with maximum acceleration. Spinning at this speed lasted 2 minutes.

Two rinse cycles each lasting 2 minutes followed, in which the tub movement was reduced to 31 rpm and then accelerated to the appropriate speed of spinning. For each rinse, 680 liters of water at 95° C. were let in.

A final rinse cycle followed with 680 liters of water at 95° C., in which the final spin lasted 10 minutes at 228.5 g (520 rpm). Then the clothes were unloaded within one minute, while the machine was being slightly tilted.

Effective working periods were: 5 minutes for loading, 18 minutes for washing and rinsing, 10 minutes for final spinning and 1 minute for unloading, totalling 34 minutes. In addition, the periods during which the suds were added or drained, the tub was slowed down after spinning, etc. totalled 5 minutes, 40 seconds. Thus the total duration of the washing program was 39 minutes, 40 seconds. The clothes had a residual moisture of 45%.

An embodiment of the invention is shown in the drawings and explained in detail as follows.

Figure 1:
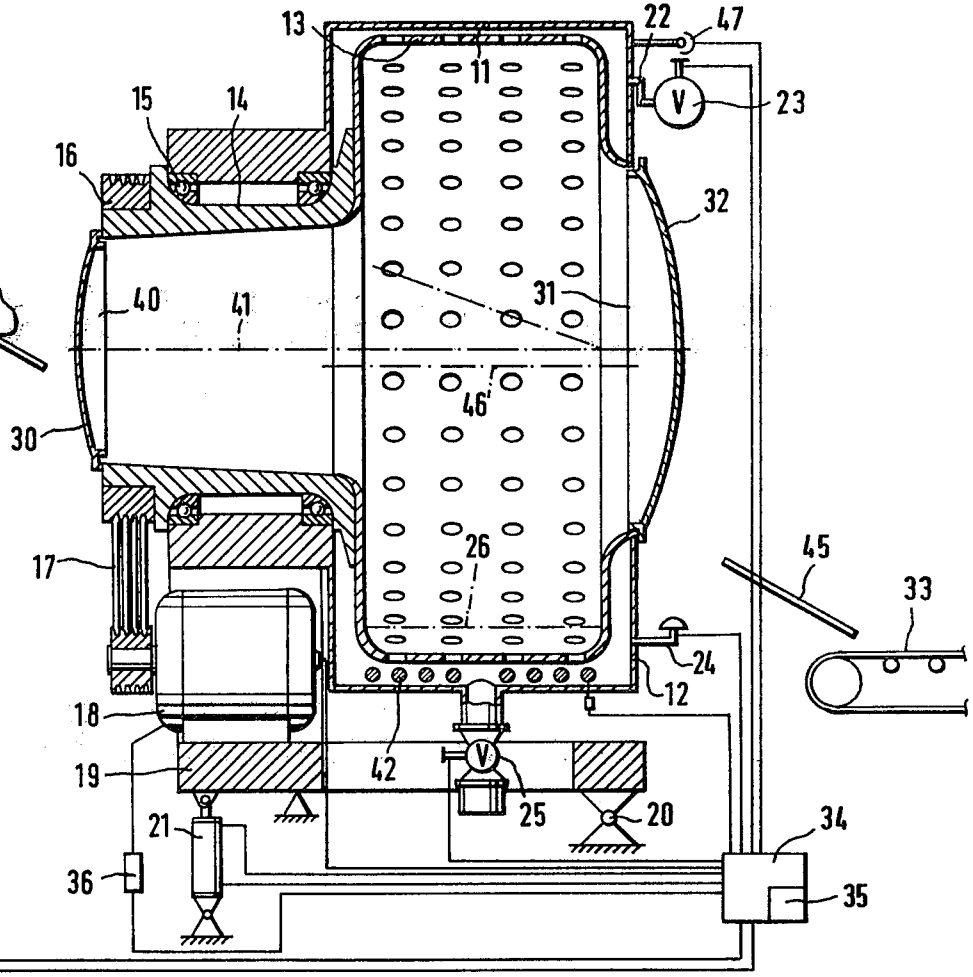
FIG. 1 shows a fully automatic washing machine with a feeding conveyor and a removal chute.

The washing machine consists of housing 11 whose lower portion serves as container pan 12 for water or suds. Housing 11 contains tub 13 which is perforated at the case surfaces and rotates about and imaginary axis 41. On one side of the tub is conical hollow shaft 14, whose smallest diameter is at the outside of the machine. Between hollow shaft 14 and the housing is mounting 15 in which tub 13 is unilaterally mounted. Hollow shaft 14 and thus also tub 14 are driven by motor 18 via drive pulley 16 and belt 17. Motor 18 is rigidly connected to housing 11 of the washing machine via drive console 19. The entire washing machine can be slightly tilted about fulcrum 20. Tilting is accomplished by drive 21 which, for example, could be hydraulic, pneumatic or electric. The suds are fed to container pan 12 of housing 11 through flexible hose 22. The suds are kept exactly at the required level 26 by means of magnetic valve 23 connected to water level control 24. The rinse water is filled in a similar fashion into container pan 12 of housing 11 through a hose not shown and through indicating and regulating devices now shown. As soon as they are no longer required, rinse water and suds flow out through discharge valve 25. Pieces of clothing 28 are conveyed fully automatically into tub 13 by means of feeding conveyor 29 and chute 27.

When the clothes are loaded, only cover 30 is open, while cover 32 remains closed.

The machine has program control unit 34 that contains a device for changing the tub speed 35 and that is connected to speed indicator 48 of motor 18. It also has oscillation control unit 47, connected to comparator circuit 49 which is connected to the program, the speed indicator and the motor control.

The device for changing the tub speed is switched on during the changeover from wash speed to spin speed, and it is only switched off after a speed of at least 2 g is attained. The device for changing the tub speed 35 can increase the speed in this range purely according to time. But with the high speeds that are indicated, it would be preferable if the above mentioned circuit were used.

After the clothes are loaded into the washing machine, the speed of tub 13 is slowly increased to ensure that the clothes are evenly distributed and pressed against tub 13 in such a manner that the centrifugal acceleration at the periphery of tub 13 reaches more than 1.5 g. Chute 27 for feeding tub 13 is pulled from loading port 40 by means of drive 43 and joint 44, and cover 30 of loading port 40 is closed.

When the clothes are washed, the washing machine is slightly tilted about fulcrum 20 in such a way that unloading port 31 is slightly lowered, and cover 32 is opened. When tub 13 rotates at a moderate speed, this causes the pieces of clothing to be expelled from unloading port 31; they fall onto chute 45 and removal conveyor 33 on which they move away. Program control unit 34 controls the individual loading and unloading programs for the clothes and the actual washing, rinsing and spinning programs. This program control unit regulates the time sequence of each process, the speeds, the water levels and the temperatures in the conventional manner.

All processes, such as loading, washing, rinsing, spinning and unloading require exactly predetermined speeds of tub 13. The speed also depends on the diameter of tub 13 and is determined in such a way that the various processes operate at the periphery of tub 13 with the following absolute values of centrifugal acceleration (in relation to the earth's acceleration):

1. for loading: between 0.3–0.5 g
2. for pressing the clothes against the tub wall: 1.5 g and over
3. for washing and rinsing: between 0.8–0.95 g
4. for spinning: $>100$ g
5. for unloading: 0.6–0.9 g Another embodiment is possible in which the device for changing the speed 35 is connected to oscillation control unit 47 in such a way that as the amplitude of oscillations decreases, the angular velocity of tub 13 is proportionately increased up to a maximum value.

In the embodiment shown in FIG. 1, the variable load of motor 18 is used to control the device to change the speed 35. As long as the clothes are not yet distributed in tub 13 without unbalance, motor 18 uses more energy than it absorbs when they are distributed without unbalance. The higher energy consumption can, for example, be measured as voltage drop by means of barrier resistor 36 in the conductor of motor 18. The smaller the voltage drop, the quicker the device for changing the speed 35 increases the angular velocity of tub 13. It is particularly advantageous when the device for changing the speed 35 is connected to oscillation control unit 47.

The connection between the device for changing the speed 35 and oscillation control unit 47 ensures that the angular velocity in the critical range directly below 1 g is regulated in inverse proportion to the unbalance which is caused by unevenly distributed clothes. The extent of unbalance can also be measured at the tub. Thus clothes that have been distributed inhomogenously and cause an unbalance have sufficient opportunity to become detached from the tub wall and to be placed elsewhere. As mentioned earlier, the result is that the tub rotates without unbalance.

Figure 2:
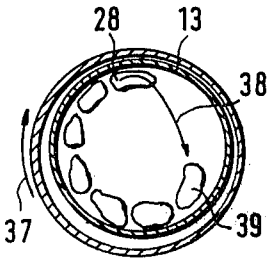
FIG. 2 shows a sectional view of the housing with the tub during a wash or rinse cycle.
Figure 3:
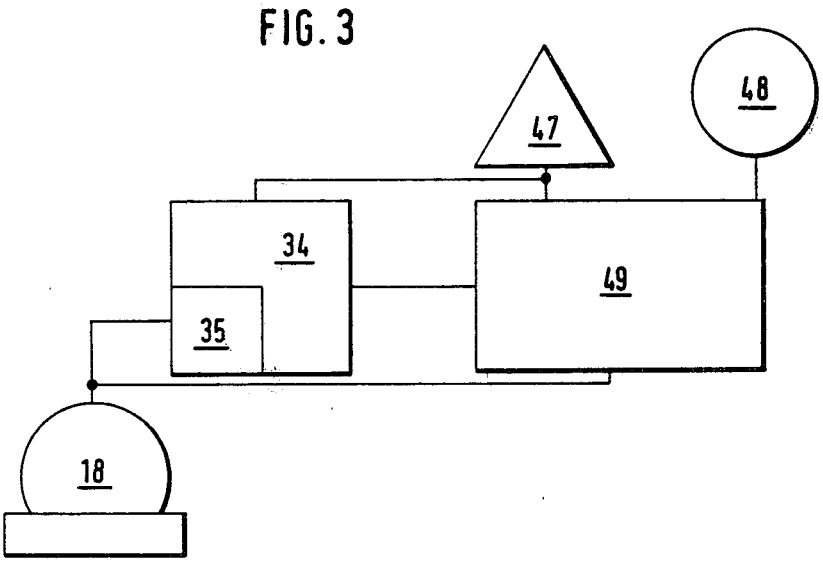
FIG. 3 shows a wiring diagram.

FIG. 2 shows the trajectory of the pieces of clothing during the wash or rinse cycle. The speed of tub 13 is just enough for the pieces of clothing to be carried along by tub 13 rotating in direction 37 to the level of piece of clothing 28. Since the speed of tub 13 produces a centrifugal acceleration which is somewhat less than that of the earth, the clothes at the level of piece of clothing 28 detach themselves from tub 13 and fall in a free trajectory, as indicated by arrow 38, to place 39 of tub 13 where they hit tub 13 with an impact which, as described earlier, causes the wash and rinse effect. Tub 13 is immersed only in the upper layers of the suds and the rinsing liquid. These upper layers are largely free of sediments because the suds or rinsing liquid are centrifugally accelerated by the rotation of tub 13, and because of that the soil particles settle and collect at the bottom of the suds container due to the centrifugal effect, and they are discharged from there. The washing machine can also be equipped with heating pipes 42. The axis of rotation 41 of tub 13 lies somewhat above centre line 46 of housing 11, so that a relatively small, tapering slit is formed between tub 13 and housing 11 above.

Via the oscillation control unit 47 which interrupts a contact when an undesirable amplitude occurs in the machine, the further run-up of the machine and the device for changing the speed 35 are stopped.

Program control unit 34 is returned to the starting point of the run-up, and after a time delay, this program control unit 34 once again causes the run-up as predetermined. This is done electrically by means a phase-intercept control which increases the energy supply for motor 18 in proportion to the time elapsed.

The washing machine shown in FIG. 1 is designed as a unilaterally mounted machine with pass-through tub. This has the advantage that, for example, hospital clothing, particularly contaminated clothes, can be loaded on one side and unloaded on the other side. For that reason, the machine could, for example, be built into the opening in a partition, in which case the opening could be elastically sealed. In this manner it can be prevented that bacteria are passed to the clean side.

In view of the high rotational speeds required, the mounting of hollow shaft 14 that is necessary presents a problem. A hydrostatic mounting is recommended to reduce friction and to prevent overheating. Such hydrostatic mountings are known, for example, for the mounting of high-speed turbines.

As mentioned above, the axis of the housing is below the axis of the tub. This excentric position has the purpose of slowing down the tub after each intermediate spinning. This is achieved by filling the housing with water and using the entire washing machine as a hydraulic brake. The turbulent water is carried along by the tub between the tub and the housing in the direction of rotation, and while a considerable pressure is built up in the upper portion of the machine, the clothes are pressed away from the tub wall.

We claim:

1. A process for the washing of clothes through a wash and rinse cycle in a washing machine with a horizontal, perforated, driven tub arranged inside a housing, wherein the tub has at its rotating periphery a tangential area, in which during the washing and rinsing cycles as the tub rotates, the clothes are repeatedly lifted up and then fall in a trajectory path onto the lower portion of the tub and are then distributed without unbalance to the tub, as the tub velocity is gradually increased, and are then centrifuged as the velocity is increased further, the improvement comprising the steps of wetting the clothes with an amount of suds that gives a "doughy" consistency to the clothes by filling the tub with suds until the level of suds does not significantly rise above the tangential area of the tub by maintaining in the tub during washing an aqueous medium level of at least about 5% of the tub's diameter, whereby the dry clothes are loaded individually into the tub which rotates at a speed at which the centrifugal velocity at the tub case is about 0.3–0.8 g, then increasing the tub speed to about 1 g, then gradually changing the speed to a spin speed and after the spinning, reducing the speed again to a velocity in keeping with the loading speed, and following the process with a rinse cycle which is similar to the washing cycle.

2. Procedure according to claim 1, characterized in that the clothes are wetted with an amount of suds that equals approximately 30–70% of the clothes' absorption capacity.

3. Procedure according to claim 1, characterized in that the medium is filled into the housing, and the medium level is maintained in the tub until the predetermined degree of wetting is reached.

4. The process of claim 1 whereby the medium level is increased to about 10% of the tub diameter, thereby achieving an even wetting of the clothes.

5. Procedure according to claim 4, characterized in that the tub is filled with water.

6. Procedure according to claim 1, characterized in that concentrated suds are used.

7. Procedure according to claim 6, characterized in that saturated suds are used, in which sediment can be present.

8. Procedure according to claim 1, characterized in that a tub without carrying-vanes is used.

9. Procedure according to claim 1, characterized in that after loading the clothes, they are washed at a tub speed at which an acceleration of about 0.8 to 0.95 g is produced at the tub case.

10. Procedure according to claim 1, characterized in that the tub velocity in the range between the washing speed and about 2 g is increased depending on the unbalance.

11. Procedure according to claim 10, characterized in that when an unbalance occurs, the tub velocity is reduced to below 1 g before it is accelerated again.

12. Procedure according to claim 1, characterized in that the tub velocity of spinning is between about 3–350 g.

13. Procedure according to claim 1, characterized in that at the end of spinning, water is filled into the housing.

14. Procedure according to claim 13, characterized in that the water is filled between housing and tub in a quantity that ensures a considerably high dynamic pressure.

15. Procedure according to claim 1, characterized in that one wash cycle and 1–3 rinse cycles are used for the washing process.

16. Procedure according to claim 1, characterized in that for all rinse cycles, water is used with a temperature that does not exceed the temperature of the suds and that is very similar to the latter.

17. Procedure according to claim 16, characterized in that suds are used which contain detergents.

18. Procedure according to claim 1, characterized in that detergents are added to the rinse water.

19. Procedure according to claim 1, characterized in that a tub with a diameter between about 800 and 2000 mm is used.

* * * * *